United States Patent [19]

Gernez

[11] 4,385,079

[45] May 24, 1983

[54] METHOD AND APPARATUS FOR RE-IONIZING INSULATING POWDER IN AN INSTALLATION FOR ELECTROSTATICALLY DEPOSITING POWDER ON OBJECTS

[75] Inventor: Alain Gernez, Orleans, France

[73] Assignee: Societe Anonyme dite: Compagnie Europeene Pour l'Equipement, Menager "CEPEM", Paris, France

[21] Appl. No.: 237,968

[22] Filed: May 1, 1981

[30] Foreign Application Priority Data

Mar. 5, 1980 [FR] France ..... 80 04906

[51] Int. Cl.[3] ..... B05B 5/04; B05D 1/06

[52] U.S. Cl. ..... 427/33; 118/627; 118/634; 118/638

[58] Field of Search ..... 118/634, 638, 627; 361/226, 229, 230; 427/33

[56] References Cited

U.S. PATENT DOCUMENTS

| | | | |
|---|---|---|---|
| 1,735,494 | 11/1929 | Chapman | 361/230 |
| 3,905,785 | 9/1975 | Fabre | 118/634 X |
| 4,301,764 | 11/1981 | Campion et al. | 118/634 |

FOREIGN PATENT DOCUMENTS

| | | |
|---|---|---|
| 2442080 | 6/1980 | France . |
| 1413964 | 11/1975 | United Kingdom . |
| 1530508 | 11/1978 | United Kingdom . |

*Primary Examiner*—Evan K. Lawrence

*Attorney, Agent, or Firm*—Kenyon & Kenyon

[57] ABSTRACT

An apparatus and method of using the apparatus for electrostatically depositing powder on moving objects. The apparatus includes powder-spraying chamber, air-filtering units adjacent the entrance and exit of the chamber, and at least one re-ionization chamber disposed between an air-filtering unit and the powder-spraying chamber. Each re-ionization chamber has walls extending transversely to the direction of motion of the objects through the apparatus to direct powder towards the objects on which powder is to be deposited.

12 Claims, 3 Drawing Figures

A
B
C
D
E
1
2
3
5
8
9
10
11
12
13
14
20
21
22
23
28
29

METHOD AND APPARATUS FOR RE-IONIZING INSULATING POWDER IN AN INSTALLATION FOR ELECTROSTATICALLY DEPOSITING POWDER ON OBJECTS

The invention relates to a method and apparatus for re-ionizing an insulating powder in an installation for electrostatically depositing powder on objects. Here, re-ionization means electrostatically charging powder for a second time after it has previously been electrostatically charged. This is done e.g. by electrostatic spray guns.

BACKGROUND OF THE INVENTION

Powder of high resistivity is electrostatically applied onto a part to be treated by spraying the part with a stream of powder electrified by charges produced by pins connected to a high-tension DC generator.

The electrified powder adheres to the part under the effect of electrostatic forces. Subsequent heat treatment applied to the part makes it possible to transform the layer of powder into a finished coat of paint or vitrified enamel.

U.S. patent application Ser. No. 97,112, filed Nov. 20, 1979, now U.S. Pat. No. 4,304,764 describes a booth which includes electrodes brought to a high electric potential, said electrodes being disposed at the inlet and at the outlet of an electrostatic powder-deposition chamber, but this booth does not make it possible to obtain good results. Not all the powder is charged or the powder is insufficiently charged. As a result, a more or less large fraction of the powder is not deposited on the parts.

In a booth in accordance with French Pat. No. 2 442 080 powder not deposited on a part either falls directly through a sifter into a recovery tank situated at the base of the booth or else is directed towards filters disposed in inlet and outlet modules.

The present invention aims to increase the proportion of powder which is deposited on the parts to be treated.

SUMMARY OF THE INVENTION

The invention provides apparatus for re-ionizing insulating powder in an installation for electrostatically depositing powder on objects passing therethrough, said installation including a powder-spraying chamber and air-filtering units for sucking in powder that is not deposited on the objects, wherein the re-ionizing apparatus comprises at least one re-ionization unit to re-ionize the non-deposited powder, the re-ionization unit being situated in a re-ionization chamber which is adjacent to the powder-spraying chamber, the re-ionization chamber having walls extending transversely to the direction of motion of the objects through the apparatus to direct the powder towards said objects on which powder is to be deposited, said walls being situated between the powder-spraying chamber and the suction openings via which air is sucked through the filtering units.

The invention also provides a method of re-ionizing powder in an installation for electrostatically depositing powder on objects, said installation including a powder-spraying chamber, wherein the method consists in using powder-re-ionization means disposed at the outlet of the powder-spraying chamber in a powder-re-ionization chamber and in placing walls transverse to the direction of motion of the objects along the path of the powder to direct the powder towards the objects to be treated.

BRIEF DESCRIPTION OF THE DRAWINGS

A preferred embodiment of the invention is described hereinbelow with reference to the accompanying drawings in which.

DESCRIPTION OF PREFERRED EMBODIMENT

Figure 1:
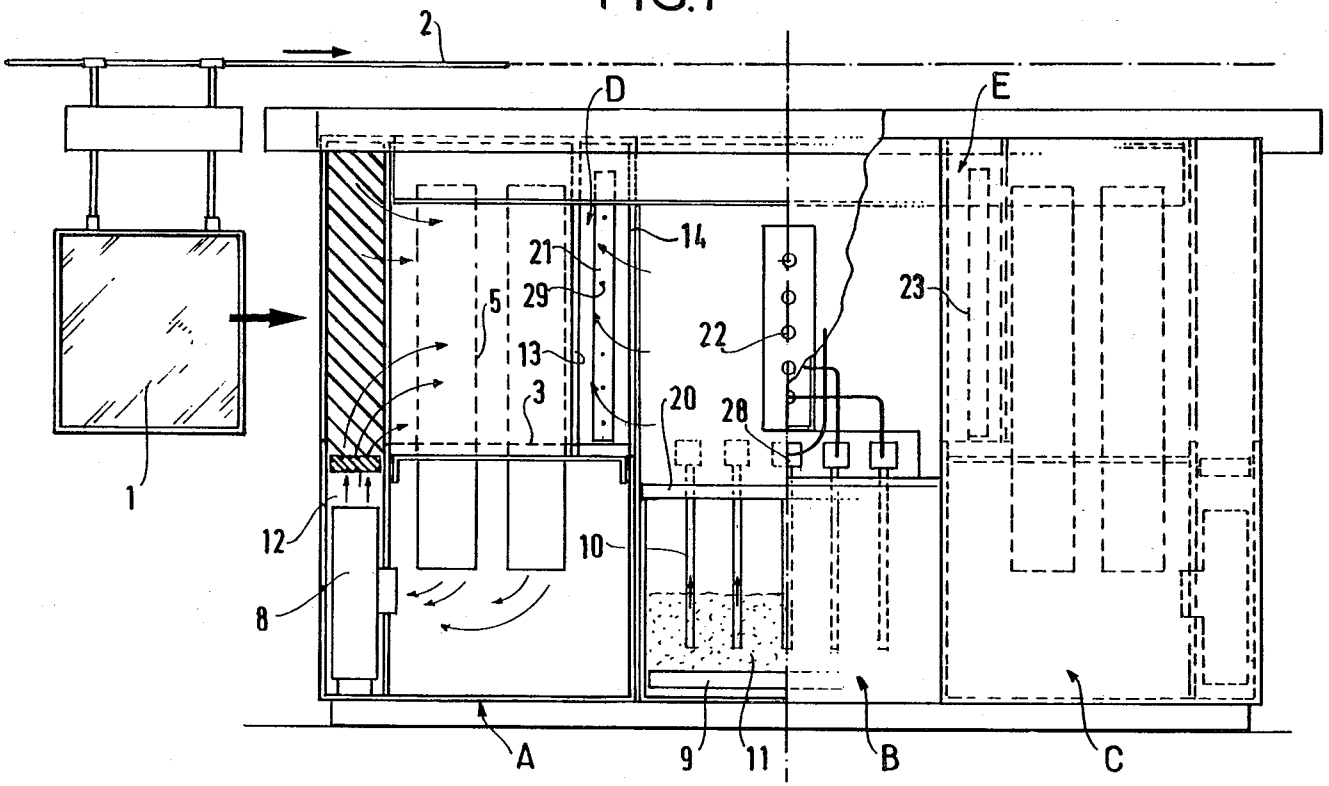
FIG. 1 is an elevation of a powder-deposition booth which includes re-ionization units in accordance with the invention.
Figure 2:
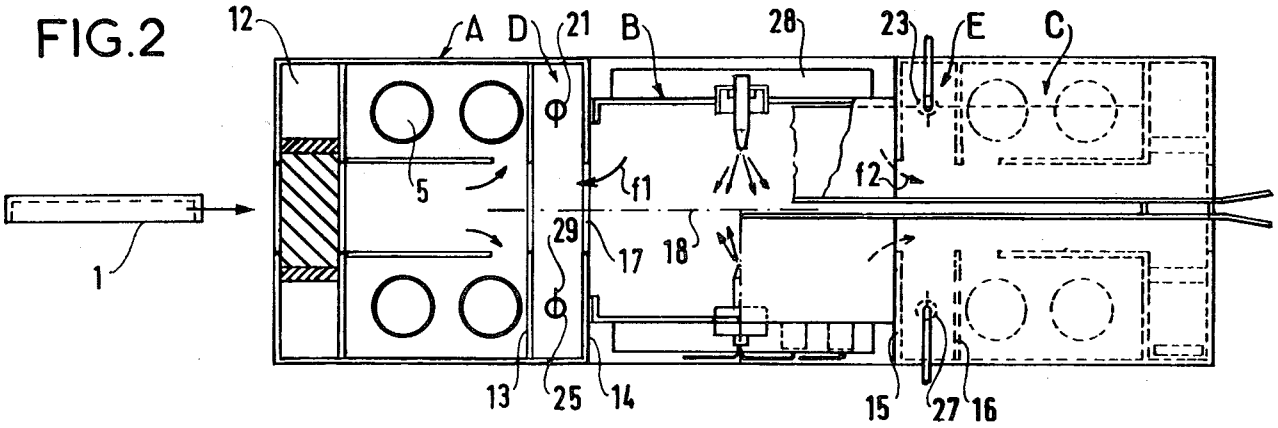
FIG. 2 is a plan view of the booth of FIG. 1.
Figure 3:
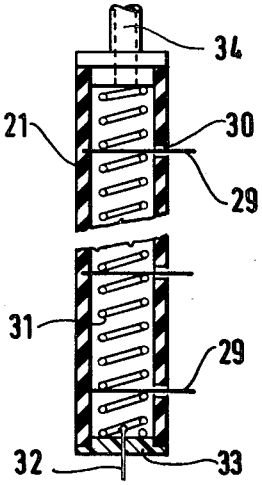
FIG. 3 is a cross-section of a re-ionization pipe.

In the embodiment illustrated, parts 1 placed on a conveyor 2 pass through a powder-depositing booth which includes three modules A,B,C: module A serves as an inlet air-lock, module B is the spray chamber where powder is to be deposited on the parts by means of projection units 22, and module C is an outlet air-lock. The inlet module A and the outlet module C contain vertical cylindrical filters 5 which are, for example, four in number. A fan 8 placed in a box 12 sucks air in through the filters, and an unclogging unit (not shown) is used to regenerate the filters.

A fluidizing unit 3 situated at the bases of the filters recovers the powder which falls from the filters and returns it to a powder store 11 situated in module B of the booth. Module B contains a fluidization unit 9 and a sifter 20. The powder depositing units 22 can be of any type, e.g. electrostatic spray guns. The powder depositing units 22 are connected to injectors 28 which draw off the powder directly by means of dipping tubes 10 in the powder store 11.

The inlet module A and the outlet module C have respective re-ionization compartments D and E, adjacent to the central module B. These re-ionization compartments could alternatively be disposed in the central module B. A re-ionization compartment is constituted by solid walls 13,14,15,16 which leave a central passage 17 for the parts to be treated. These walls constitute obstacles in the path of the powder and thereby help to confine the powder in the powder deposition module B, causing considerable loss of head when the powder passes from the powder deposition chamber B to the filtering chambers A and C. These obstacles oblige the powder which takes part in this transfer to move towards the central axis 18 of the booth in the direction of arrows $f_1$, $f_2$ and thus towards the parts which move through the booth. The fraction of powder which is still charged is redeposited on the parts. The re-ionization compartments D, E further include ionization units 21, 23, 25 and 27 constituted by insulating tubes extending vertically up the entire height of the booth. Pins 29 pass through holes 30 in these tubes, leaving a space around the pins where they pass through the holes. The pins are fixed on the tube along the generatrix that is furthest from the holes by a fixing means such as nailing or the like. The pins 29 point towards the centre of the booth perpendicularly to the path followed by the parts, and pass through an electrically conductive member 31 which is connected to the high-tension supply by a conductor 32. The high-tension supply is an electrostatic generator which can be the same as that used for the spray guns in module B; the pins 29 are thus in contact with the conductive member 31 which brings them to high potential for re-ionizing the powder. The conductive member 31 is constituted by a helical spring suspended along the axis of the tube with the pins 29 passing between its turns. The conductive member 31 could alternatively be constituted by metal braiding. The pins are disposed along a generatrix along the entire height of the tube; the pins should be spaced at a spacing lying between 10 mm and 100 mm apart, for example.

To avoid electrostatic leakage, the insulating tube 21 is closed at one end by an insulating plug 33 through which the high-tension input conductor 32 passes; the other end of said insulating tube is connected to a compressed air supply unit (not shown) via a tube 34.

During operation, the pins 29 are brought to a high electric potential by means of the member 31 so as to ionize the powder, the tube being supplied with compressed air which, on leaving via the holes surrounding the pins, prevents powder from being deposited on said pins, as this would impair proper ionization of the air and of the powder in the compartment.

Use of this system not only increases the powder deposition efficiency by making the powder move towards the parts and by re-ionizing the powder, but also, by increasing direct recovery in the powder deposition chamber and by improving the efficiency of deposition, reduces the quantity of powder deposited on the filtering components thereby facilitating their unclogging. The walls of the re-ionization chamber increase the density of powder in the powder deposition chamber.

Further, the system improves the evenness of the thickness of the powder deposition on the parts. Suction by the filters evens out the density of powder up the entire height of the booth and therefore provides uniform deposition on the parts.

A plurality of successive re-ionization chambers can be disposed along the path of the powder as it goes from the powder-spraying chamber to the filters.

I claim:

1. Apparatus for electrostatically depositing powder on objects passing therethrough, said apparatus including a powder-spraying chamber having an entrance and an exit, means for supplying a cloud of electrostatically charged powder in the powder-spraying chamber, and air-filtering units having suction openings adjacent to said entrance and exit of the powder-spraying chamber, for sucking in powder that is not deposited on the objects, wherein the improvement comprises at least one re-ionization chamber disposed between a corresponding one of said air-filtering units and the powder-spraying chamber and a re-ionization unit positioned in each re-ionization chamber, each re-ionization chamber having walls extending transversely to the direction of motion of the objects through the apparatus to direct the powder towards said objects on which powder is to be deposited, said walls being situated between the powder-spraying chamber and the suction openings via which air is sucked through the filtering units, and the re-ionization unit being positioned in a recess between said transverse walls of the re-ionization chamber.

2. Apparatus according to claim 1, wherein the re-ionization unit comprises a tube made of an insulating substance, pins projecting out of said tube through one side wall thereof and fixed on the opposite wall of the tube, and electrically conductive means inside the tube for connecting the pins to a source of high electric potential.

3. Apparatus according to claim 2, wherein said electrically conductive means comprises a spiral spring lying along the axis of the pipe, the turns of said spring being in contact with the pins.

4. Apparatus according to claim 2, wherein said electrically conductive means comprises metal braiding through which the pins pass.

5. Apparatus according to claim 2, wherein the pins project through the centres of holes through the insulating wall of the tube, said holes being located diametrically opposite the points where the pins are fixed to the tube, and gaps being left around the pins where they pass through the holes to enable a flow of air to leave the tube.

6. Apparatus according to claim 5, wherein the pins are spaced on a generatrix along the entire length of the tube.

7. Apparatus according to claim 6, wherein the pins are evenly spaced apart along a generatrix of the tube, the spacing being between 10 mm and 100 mm.

8. Apparatus according to claim 5, wherein one end of the insulating tube is closed, and the other end includes means for connection to a supply of compressed air.

9. Apparatus according to claim 1, wherein the at least one re-ionization chamber includes at least two pairs of re-ionization chambers, at least a pair of chambers being disposed on either side of the entrance and on either side of the exit of the powder-spraying chamber, respectively, each pair of re-ionization chambers comprising a re-ionization compartment.

10. Apparatus according to claim 9, wherein the means for supplying a cloud of electrostatically charged powder comprises electrically-charged spray nozzles and an electrostatic generator which feeds the re-ionization units and the nozzles.

11. Apparatus according to claim 9 or 10, wherein the at least a pair of re-ionization chambers comprising a re-ionization compartment include a plurality of re-ionization compartments disposed one compartment after another.

12. A method for electrostatically depositing powder on objects in an installation, the method including transporting objects to be coated with powder successively through a first enclosed zone and a second enclosed zone in said installation, each zone having an entrance opening and an exit opening for passing said objects; supplying a cloud of electrostatically charged powder within one of said first and second enclosed zones; withdrawing air from the other of said first and second zones adjacent the opening thereof nearest the one zone; filtering the withdrawn air; and returning the filtered air through the other opening of the other zone, wherein the improvement comprises:

connecting the exit opening of the first zone to the entrance opening of the second zone by a third enclosed zone having a cross section larger than the exit and entrance openings of the first and second zones, respectively, and disposing powder reionization means in said third zone adjacent to but spaced laterally away from said exit and entrance openings of the first and second zones, respectively.

* * * * *